US006245198B1

(12) United States Patent
Kinnunen et al.

(10) Patent No.: US 6,245,198 B1
(45) Date of Patent: Jun. 12, 2001

(54) ARRANGEMENT OF THREADING IN A CALENDER

(75) Inventors: Jorma Kinnunen, Helsinki; Juha Laitio, Espoo, both of (FI)

(73) Assignee: Valmet Corporation (FI)

( * ) Notice: Subject to any disclaimer, the term of this patent is extended or adjusted under 35 U.S.C. 154(b) by 0 days.

(21) Appl. No.: 09/530,714

(22) PCT Filed: Oct. 30, 1998

(86) PCT No.: PCT/FI98/00846

§ 371 Date: Oct. 6, 2000

§ 102(e) Date: Oct. 6, 2000

(87) PCT Pub. No.: WO98/23304

PCT Pub. Date: May 14, 1999

(30) Foreign Application Priority Data

Nov. 4, 1997 (FI) ..... 974121

(51) Int. Cl.[7] ..... D21F 3/00; B30B 3/04

(52) U.S. Cl. ..... 162/360.3; 100/173

(58) Field of Search ..... 162/193, 205, 162/206, 283, 286, 358.1, 360.2, 360.3, 361; 100/35, 38, 47, 161, 162 B, 162 R, 163 A, 163 R, 168, 328, 329, 331, 167, 173; 226/91, 92, 93, 97.3, 97.4

(56) References Cited

U.S. PATENT DOCUMENTS

| | | | |
|---|---|---|---|
| 2,714,840 | 8/1955 | Bayrer et al. | 92/73 |
| 3,355,349 | 11/1967 | Devlin | 162/286 |
| 4,022,366 | 5/1977 | Rooney | 226/91 |
| 4,186,860 | 2/1980 | Reba | 226/91 |
| 5,784,955 * | 7/1998 | Conrad | 100/329 |

FOREIGN PATENT DOCUMENTS

| | | | |
|---|---|---|---|
| 2365438 | 2/1975 | (DE) | D21F/5/00 |
| 19542191 | 5/1987 | (DE) | B30B/3/00 |
| 29518424 | 4/1996 | (DE) | D21G/1/00 |
| 761364 | 3/1982 | (FI) | D21F/7/00 |
| 793202 | 9/1983 | (FI) | D21F/7/00 |
| 763617 | 11/1986 | (FI) | D21F/7/00 |
| 955770 | 5/1997 | (FI) | D21F/7/00 |

* cited by examiner

*Primary Examiner*—Stanley S. Silverman
*Assistant Examiner*—Eric Hug
(74) *Attorney, Agent, or Firm*—Steinberg & Raskin, P.C.

(57) ABSTRACT

The invention concerns an arrangement of threading of a paper web (W) in a supercalender, which comprises an upper roll (12), a lower roll (13), and a stack of rolls consisting of intermediate rolls (14 . . . 23) and fitted between said upper and lower roll. The rolls (12 . . . 23) in the calender arm in nip contact ($N_1 \ldots N_{11}$) with one another. At the sides of the stack of rolls, alternatingly at the left side and at the right side, a take-out leading roll (101 . . . 110) has been fitted at each intermediate roll (14 . . . 23). The arrangement of threading comprises at least one loop of a transfer belt (Z), which is penetrable by air and which runs outside the edge of the paper web (W) through at least two nips ($N_1 \ldots N_{11}$) in the calender. The transfer belt (Z) passes the lead-in strip ($W_1$) of the paper web through at least one nip ($N_1 \ldots N_{11}$) in the calender. In addition to this, the arrangement of threading comprises at least one suction box (201 . . . 205; 210 . . . 219), which is placed on a free run of the paper web (W) and of the transfer belt (Z) between intermediate rolls (14 . . . 23) and takeout leading rolls (101 . . . 110) in the calender. The lead-in strip is kept in contact with the transfer belt by means of the suction of a suction box.

15 Claims, 5 Drawing Sheets

ARRANGEMENT OF THREADING IN A CALENDER

FIELD OF THE INVENTION

The present invention relates to a multi-roll calender for threading a paper web, the multi-roll calender including an upper roll, a lower roll and at least one intermediate roll.

BACKGROUND OF THE INVENTION

In the DE Utility Model 29 518 424 U1, a calender for a paper machine is described in which the threading of the paper web takes place by means of ropes. In the solution, two ropes are employed, which form an endless loop and which run at one side of the paper web through the calender. The ropes form a rope gap before the calender, into which rope gap the lead-in strip is guided, after which the strip runs between the ropes through the calender. After the calender the ropes are separated from one another and deliver the lead-in strip to the process steps following after the calender. In said publication it is also stated that, as an alternative of, or in addition to, the ropes, it is possible to employ a conveyor belt. What is concerned is a perforated conveyor belt that forms an endless loop and that runs around two reversing rolls placed at a distance from one another. One of the reversing rolls is provided with a drive gear. Below the upper portion of the conveyor belt, which carries the lead-in strip, there is a suction box, by whose means a vacuum is applied through the perforated conveyor belt to the lead-in strip, in which connection the lead-in strip is made to adhere to the conveyor belt. In the publication it is also stated that, as a supplement to the threading devices mentioned above, it is further possible to use guide plates for air jets or air in themselves known.

The solution that is described in said DE Utility Model 29 518 424 U1 and connected with ropes is problematic, because the lead-in strip that runs between two ropes tends to collide against the rope guide pulleys and against other constructions in whose vicinity the pair of ropes runs, in which connection the lead-in strip is readily separated from the ropes. On the other hand, the use of a solution of a separate loop of a perforated conveyor belt formed around reversing rolls and provided with a suction box requires that the lead-in strip is transferred between separate devices as well as additional arrangements at the take-out leading rolls in order that the lead-in strip could be made to turn back towards the set of rolls of the calender.

In the FI Patent 57,990, a threading device for a paper web is described. The threading device comprises a perforated conveyor belt which forms an endless loop and which runs around two reversing rolls placed at a distance from one another. One of the reversing rolls is provided with a drive gear. Below the upper portion of the conveyor belt, which carries the lead-in strip, there is a suction box, by whose means a vacuum is applied through the perforated conveyor belt to the lead-in strip, in which connection the vacuum makes the lead-in strip adhere to the conveyor belt. Normally, the lead-in strip is separated from the conveyor belt by means of a jet of air applied to the bottom face of the lead-in strip through the perforated conveyor belt at the delivery end of the belt. In said patent, an improvement is suggested for said process of separation of the lead-in strip. The means of separation of the lead-in strip comprise a covering member, which is fitted in connection with the roll at the delivery end of the conveyor belt so that, together with the outer face of the conveyor belt that runs around the roll, said covering member defines a slot or an opening. The covering member is provided with openings that open into said slot, through which openings a blowing can be directed by means of devices of compressed air into said slot and from it further in the direction against the direction of movement of the belt. Said slot is directed so in relation to the conveyor belt that the air flowing out of the slot meets the lead-in strip carried along with the conveyor belt and forces the strip to be separated from the belt. With this arrangement, the air that flows out of the slot produces vortex flows in the laminar flow of air that travels along with the conveyor belt and, at the same time, air penetrates between the belt and the lead-in strip, in which case also a lead-in strip of a low-weight paper grade is separated from the conveyor belt.

The threading arrangement suggested in said FI Patent 57,990 is inconvenient and requires a number of threading devices to be fitted along the web in order that the lead-in strip could be transferred through the set of rolls. Such a threading arrangement is best suitable for a situation in which the web has long free draws. Thus, it is not suitable for a modern calender in which the set of rolls is placed vertically and in which the draws between the calender rolls and the take-out leading rolls are relatively short.

OBJECTS AND SUMMARY OF THE INVENTION

By means of the solution in accordance with the present invention, an essential improvement is achieved as compared with the prior-art solutions. The object of the present invention is to provide an advantageous threading of a paper web that is reliable in operation and can be accomplished easily in a calender.

By means of a first embodiment of the solution in accordance with the present invention, in which just one transfer belt is employed which runs through the calender at the side of the paper web and which is penetrable by air, together with connected suction boxes, a simple and reliable threading of the paper web through the calender is achieved.

By means of a second embodiment of the solution in accordance with the present invention, which is a modification of the first embodiment so that, in stead of one transfer belt running through the calender at the side of the paper web, a number of separate transfer belts penetrable by air are employed, together with connected suction boxes, which belts run around the belt pulley of each intermediate roll and around the belt pulley of the corresponding take-out leading roll, a simple and reliable threading of the paper web through the calender is likewise achieved.

By means of a third and a fourth embodiment of the solution in accordance with the present invention, in which two transfer belts running through a supercalender at the side of the paper web are employed, together with connected suction boxes, an even more reliable threading of the paper web through the supercalender is achieved.

In a situation in accordance with the present invention with two transfer belts, the lead-in strip runs at the take-out leading rolls in the calender always between one of the transfer belts and the outer face of the mantle of the belt pulley mounted on the axle of the take-out leading roll. In a situation in which the lead-in strip runs at the take-out leading rolls between two ropes or conveyor belts, the ropes or conveyor belts slide somewhat in relation to one another, because in a curve they run along arcs of a circle with different radii. This situation is avoided completely in this solution in accordance with the present invention. Also the control of the tension of the lead-in strip is highly successful in the solution in accordance with the present invention so that the running speeds of the two transfer belts are kept equal.

The solution in accordance with the present invention can be employed in a multi-roll calender, which comprises an upper roll, a lower roll, and at least one intermediate roll fitted between the upper roll and the lower roll, which rolls have been arranged as a substantially vertical stack of rolls on the frame of the calender, in which connection the rolls that are placed one above the other are in nip contact with each other. Besides the above rolls, the calender must comprise a take-out leading roll fitted at the side of the stack of rolls at each intermediate roll alternatingly at the left side and at the right side. The transfer belt or belts run(s) over belt pulleys mounted on the axles of the intermediate rolls and take-out leading rolls or on narrower portions fitted at the ends of the rolls. By means of this arrangement, if necessary, it is possible to vary the speed of the belt or belts in relation to the speeds of the calender rolls. It is also possible to think that the transfer belt or belts run directly on narrower portions provided at the ends of the rolls, but in such a case the speed(s) of the belt or belts would be the same as the speeds of the rolls.

BRIEF DESCRIPTION OF THE DRAWINGS

The invention will be described in the following with reference to the accompanying drawings, in which some preferred embodiments of the invention are illustrated, the invention being, however, not supposed to be confined to the details of said embodiments alone.

DETAILED DESCRIPTION OF THE INVENTION

Figure 1:
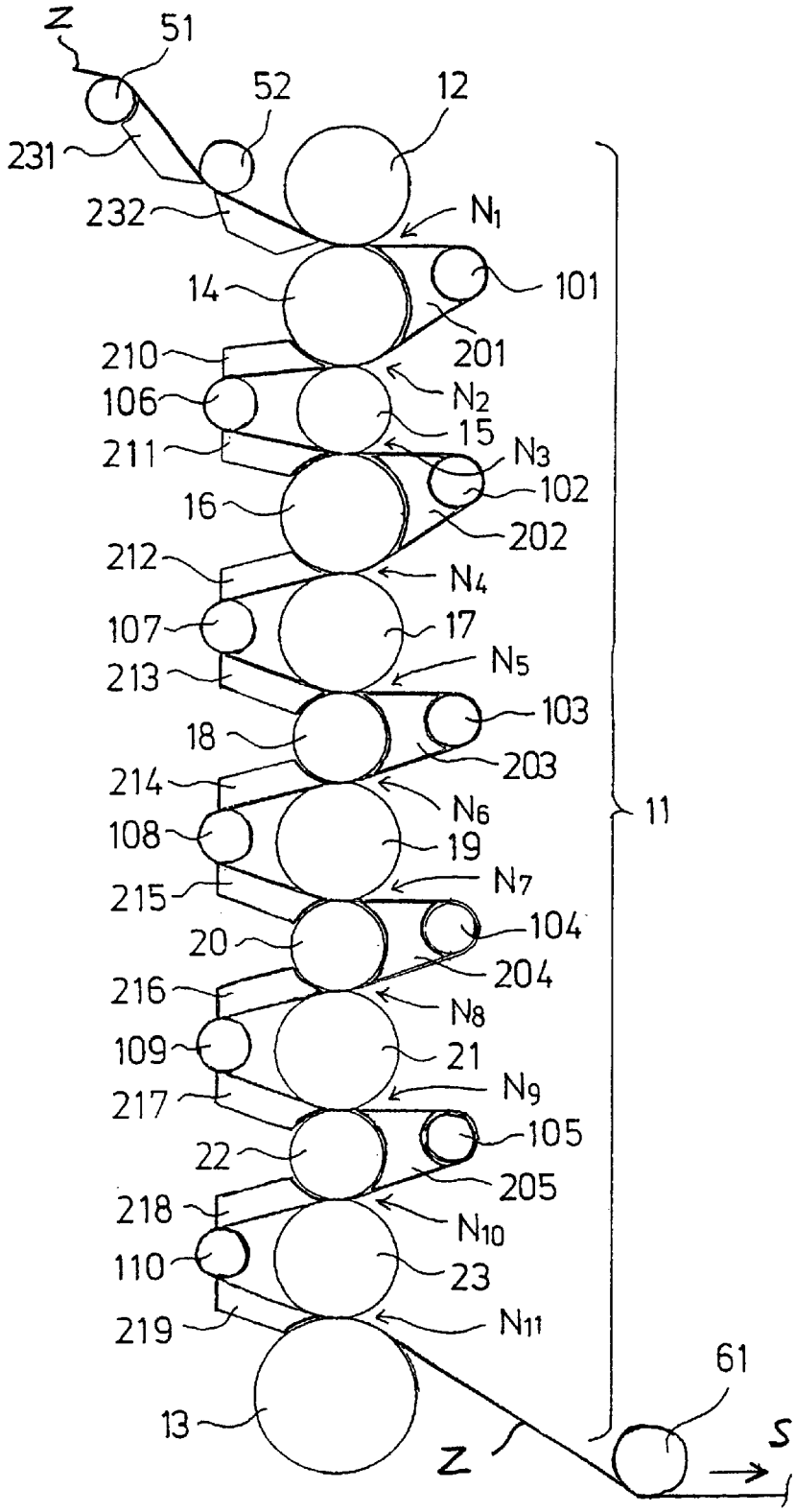
FIG. 1 is a schematic side view of an arrangement of threading of a paper web in accordance with the present invention in a calender.

FIG. 1 is a side view of an arrangement of threading of a paper web in accordance with the invention in a supercalender. The supercalender consists of a frame (not shown in the figure), on which a stack 11 of rolls consisting of a number rolls has been mounted in a vertical plane. The stack 11 of rolls comprises an upper roll 12, a lower roll 13, and a number of intermediate rolls 14 . . . 23 fitted one above the other between the lower roll 13 and the upper roll 12, said rolls 12 . . . 23 being arranged so that they are in nip contact with one another. The paper web W is passed in the supercalender over the alignment rolls 51,52 into the upper nip $N_1$ and further through the other nips $N_2$ . . . $N_{10}$ in the supercalender and finally out from the lower nip $N_{11}$ and further over the alignment roll 61 into the subsequent steps in the process. The running direction of the paper web W is, in the figure, denoted with the arrow S. Between the nips $N_1$ . . . $N_{11}$, the paper web W is taken apart from the faces of the intermediate rolls 14 . . . 23 by means of take-out leading rolls 101 . . . 110.

Figure 2:
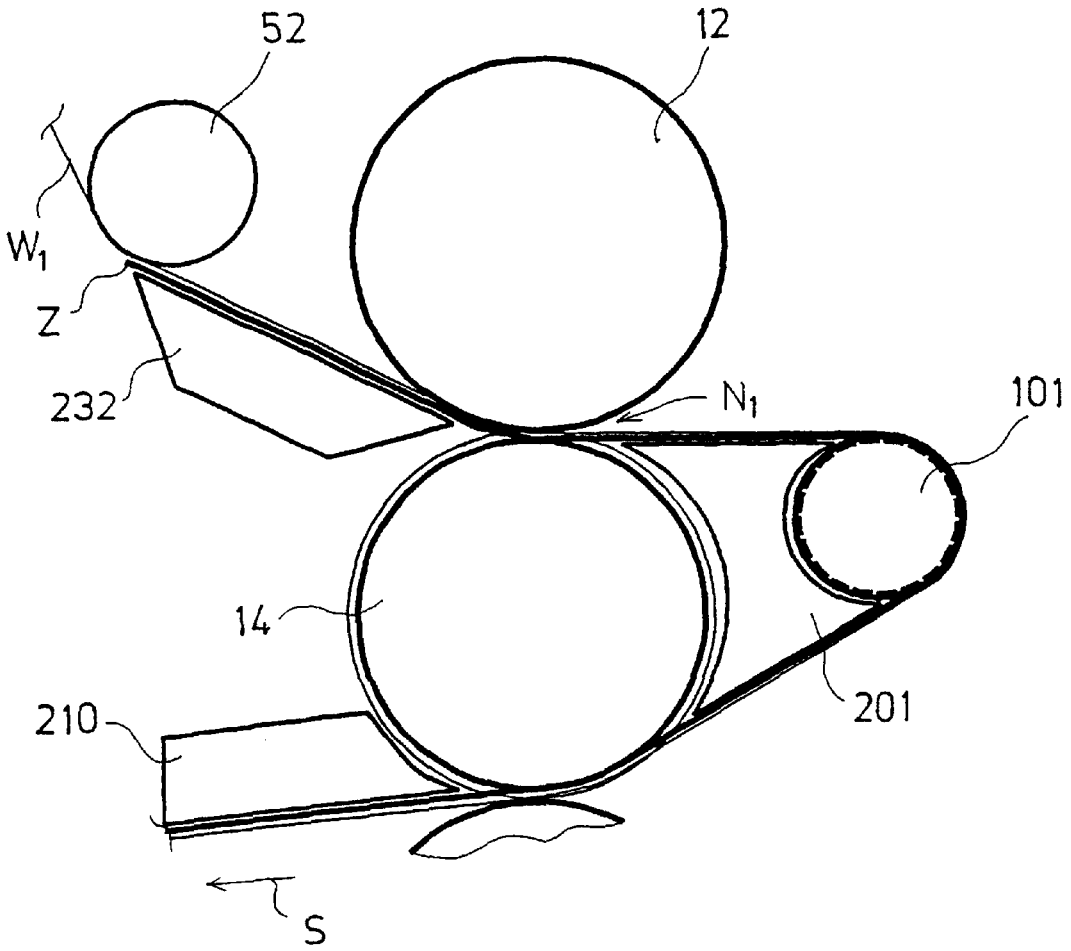
FIG. 2 is a schematic enlarged view of the top portion of FIG. 1.
Figure 3:
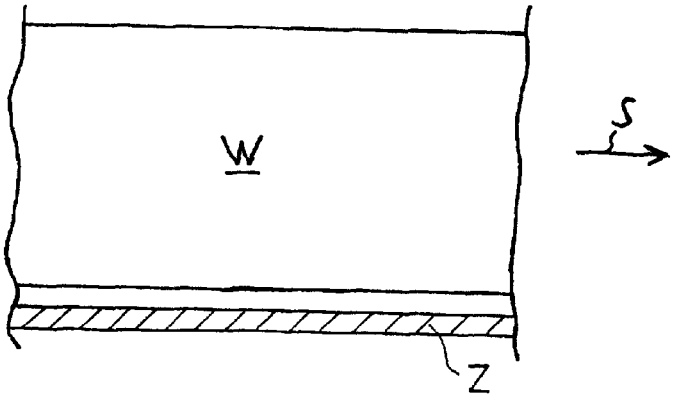
FIG. 3 is a schematic illustration of the running of the transfer belt at the side of the paper web, as viewed from above.

It is seen from FIGS. 2 and 3 that the arrangement of threading of a paper web in accordance with the invention described above includes a transfer belt Z penetrable by air which runs outside the edge of the paper web W at a distance from the edge of the paper web W through the whole supercalender, by means of which belt the lead-in strip $W_1$ of the paper web W is carried through the supercalender. The transfer belt Z runs over belt pulleys (not shown in the figure) mounted on the axles of the intermediate rolls and take-out leading rolls. The transfer belt Z forms a closed loop, but FIG. 1 does not show the return circulation of the transfer belt loop Z from the outlet end of the calender to the inlet end. The return circulation has been arranged in a way in itself known by means of guide rolls.

In FIG. 1, in the area defined by the belt pulleys of the intermediate rolls 14, 16, 18, 20,22, by the belt pulleys of the take-out leading rolls 101 . . . 105 placed at the right side of said intermediate rolls, and by the transfer belt Z, the first suction boxes 201 . . . 205 have been arranged. Said first suction boxes 201 . . . 205 are placed at the opposite side of the transfer belt Z, in relation to the lead-in strip $W_1$. By means of said first suction boxes 201 . . . 205, suction is applied to the transfer belt Z, which suction keeps the lead-in strip $W_1$ adhering to the transfer belt Z penetrable by air in contact with the transfer belt Z. In FIG. 1, the belt pulleys of the take-out leading rolls 101 . . . 105 placed at the right side of the intermediate rolls 14,16,18,20,22 have been provided with grooves running around the outer faces of the belt pulleys, in which case the suction of the suction boxes 201 . . . 205 is applied to the transfer belt Z and thereby to the lead-in strip $W_1$ also at the outside curve on the belt pulleys. By means of this arrangement, the lead-in strip $W_1$, which runs on the opposite side of the transfer belt Z, in relation to the outer face of the belt pulley placed adjacent to the take-out leading roll 101 . . . 105, i.e. which runs outside, is kept in contact with the transfer belt Z during the reversing. Instead of grooves provided on the belt pulleys of the take-out leading rolls 101 . . . 105, it is also possible to employ belt pulleys whose outer mantles are perforated and which are provided with suction zones of their own, by whose means the lead-in strip $W_1$ is kept in contact with the transfer belt Z on said outside curves. Instead of suction zones, it is also possible to employ a perforated mantle of the belt pulley and a vacuum that acts upon the whole interior of the belt pulley.

In FIG. 1, on the free runs of the transfer belt Z between the belt pulleys of the intermediate rolls 15,17,21,23 and the belt pulleys of the take-out leading rolls 106 . . . 110 placed at the left side of said intermediate rolls, suction boxes 210 . . . 219 have been provided. Also these suction boxes 210 . . . 219 are placed at the opposite side of the transfer belt Z, in relation to the lead-in strip $W_1$. In FIG. 1, on the belt pulleys of the take-out leading rolls 106 . . . 110 placed at the left side of the belt pulleys of the intermediate rolls 15,17, 19,21,23, the lead-in strip $W_1$ is kept in contact with the transfer belt Z while pressed between the belt pulleys of the take-out leading rolls 106 . . . 110 and the transfer belt Z.

The entering of the paper web W into the first nip $N_1$ in the supercalender takes place over the alignment rolls 51,52, and on the free run between said alignment rolls 51,52, at the transfer belt Z, a suction box 231 is provided. Also, on the free run between the alignment roll 52 and the upper nip $N_1$ in the calender, at the transfer belt Z, a suction box 232 is provided. By means of these suction boxes 231, 232, the lead-in strip $W_1$ is kept in contact with the transfer belt Z when the lead-in strip is being passed to the calender.

Thus, the lead-in strip $W_1$ is kept in contact with the transfer belt Z through the whole supercalender. On the free runs between the belt pulleys of the nip rolls 12 . . . 23 and the belt pulleys of the take-out leading rolls 101 . . . 110, this takes place by means of the vacuum present in the suction boxes 201 . . . 219. On the belt pulleys of the take-out leading rolls 106 . . . 110 placed at the left side of the intermediate rolls 15,17,19,21,23, the lead-in strip $W_1$ is pressed between the transfer belt Z and the outer face of the belt pulley of the take-out leading roll 106 . . . 110. At the belt pulleys of the take-out leading rolls 101 . . . 105 placed at the right side of the intermediate rolls 14,16,18,20,22, a vacuum is applied to the belt pulleys of the take-out leading rolls 101 . . . 105, which vacuum is effective through the transfer belt Z and keeps the lead-in strip $W_1$ in contact with the transfer belt Z during the reversing.

Thus, a constant hold is applied to the lead-in strip $W_1$, the lead-in strip $W_1$ being unable to escape from the transfer belt Z at any stage.

Figure 4:
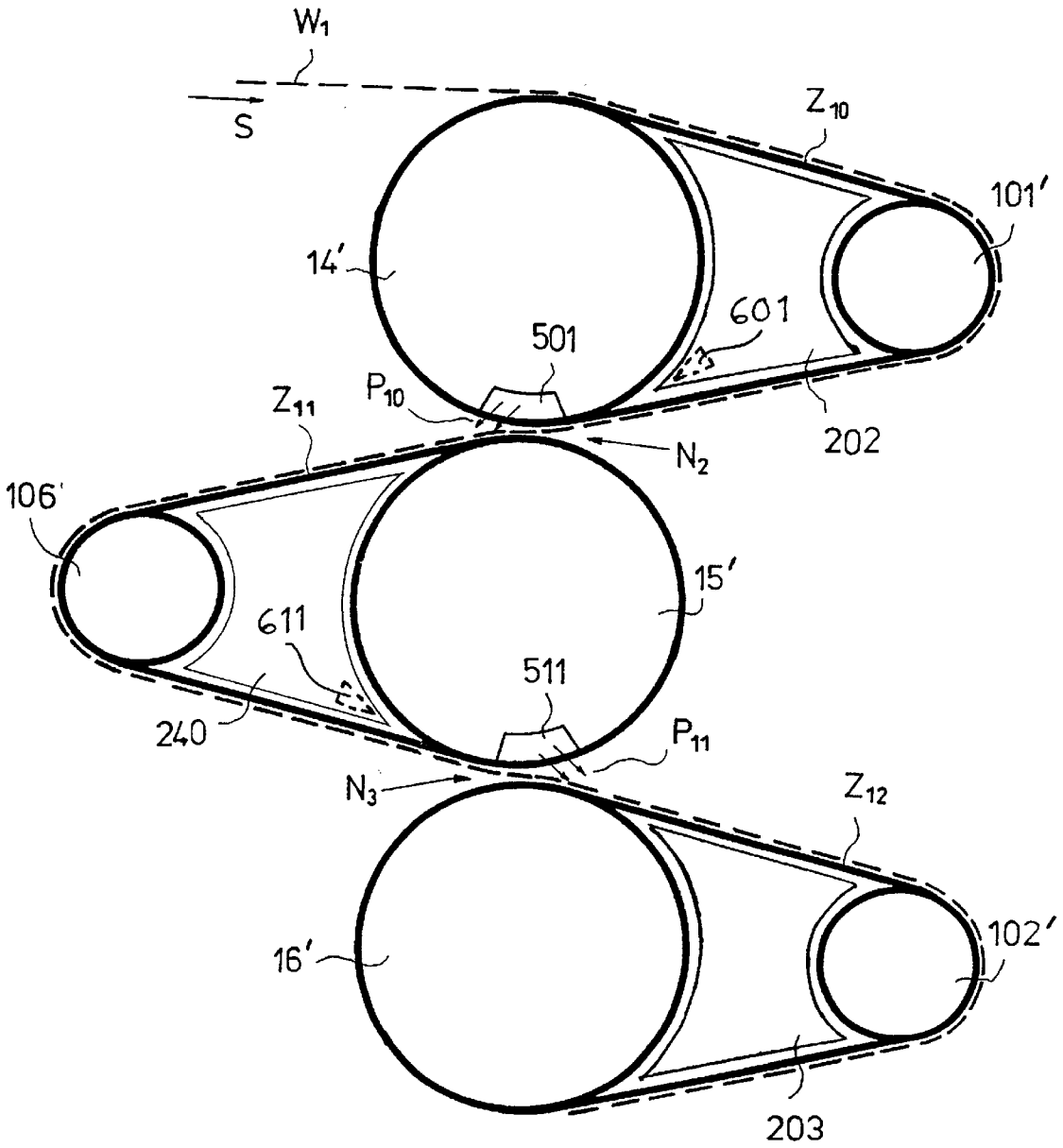
FIG. 4 is a schematic side view of a second arrangement of threading of a paper web in accordance with the present invention in a calender.

FIG. 4 shows a second arrangement of threading of a paper web in accordance with the invention in a calender. The figure shows just the belt pulleys 14',15',16' mounted on the axles of the topmost three intermediate rolls 14,15,16 and the belt pulleys 101',106'102' mounted on the axles of the corresponding take-out leading rolls 101,106,102. The outer diameter of the belt pulley 14',15',16' mounted on the axle of an intermediate roll is somewhat smaller than the outer diameter of the corresponding intermediate roll 14,15, 16 at the nip point, and the outer diameter of the belt pulley 101',106',102' mounted on the axle of the take-out leading roll 101,106,102 is substantially equal to the outer diameter of the take-out leading roll 101,106,102. In this embodiment, a transfer belt loop $Z_{10}$,$Z_{11}$,$Z_{12}$ penetrable by air and running around each pair of belt pulleys 14',101';15', 106';16',102' is employed. The belt pulleys 14',15',16' are provided with perforated mantles. Moreover, in the space defined by each pair of belt pulleys 14',101';15',106';16',102' and by the transfer belt loop $Z_{10}$,$Z_{11}$,$Z_{12}$, a suction box 202,240,203 is placed, by whose means the lead-in strip $W_1$ is kept in contact with the transfer belt $Z_{10}$, $Z_{11}$,$Z_{12}$ on the free runs of the lead-in strip $W_1$ between the belt pulley 14',15',16' of the intermediate roll and the belt pulley 101', 106',102' of the take-out leading roll. In this solution, the belt pulleys 101',106',102' of the take-out leading rolls placed at both sides of the stack of rolls are provided with grooves running around the outer faces of the mantles of the belt pulleys 101',106',102', in which connection the suction of the suction box 202,240,203 is applied to the transfer belt $Z_{10}$,$Z_{11}$,$Z_{12}$ and thereby to the lead-in strip $W_1$ also at the outside curve on the belt pulleys 101',106',102'. In stead of grooves provided on the belt pulleys 101',106',102', it is possible to use a belt pulley provided with a perforated mantle and a suction zone (compare a suction roll). In stead of a suction zone, the whole interior of the belt pulley can be subjected to a vacuum.

In the situation shown in FIG. 4, the lead-in strip $W_1$ is separated from the first transfer belt $Z_{10}$ in the nip $N_2$ by means of a blowing $P_{10}$ produced by a first blow device 501 placed inside the first transfer belt loop $Z_{10}$ and inside the belt pulley 14' substantially at the location of said nip $N_2$, and the lead-in strip is transferred onto the second transfer belt $Z_{11}$. From the second transfer belt $Z_{11}$ the lead-in strip $W_1$ is transferred in the following nip $N_3$ similarly by means of a blowing $P_{11}$ produced by a second blow device 511 placed inside the second transfer belt loop $Z_1$, and inside the belt pulley 15' substantially at the location of said nip $N_3$ onto the third transfer belt $Z_{12}$. Said blowings or air jets $P_{10}$,$P_{11}$ are applied obliquely in the direction S of progress of the transfer belt $Z_{10}$,$Z_{11}$ through the perforated outer mantle of the belt pulley 14',15' and through the transfer belt $Z_{10}$,$Z_{11}$ to the face of the lead-in strip $W_1$ that is placed against the transfer belt $Z_{10}$,$Z_{11}$ in said nip $N_2$,$N_3$.

In the situation shown in FIG. 4, in stead of the blow devices 501,511, it is possible to use a blow device 601,611 integrated in the suction boxes 202,240,203. By means of this blow device 601,611, air is blown into the closing nip between the transfer belt $Z_{10}$,$Z_{11}$,$Z_{12}$ and the belt pulley 14',15',16' of the intermediate roll. Said blow device 601,611 is placed right before the belt pulley 14',15',16' so that, by its means, air can be blown along the outer face of the lower part of the belt pulley 14',15',16' in the direction S of progress of the lead-in strip $W_1$, in which connection the holding force of the lead-in strip $W_1$ on the transfer belt $Z_{10}$,$Z_{11}$,$Z_{12}$ is lowered and the lead-in strip $W_1$ is controlled to be transferred onto the next transfer belt. In this arrangement, no belt pulley 14',15',16' that is provided with a perforated outer mantle is needed.

Figure 5:
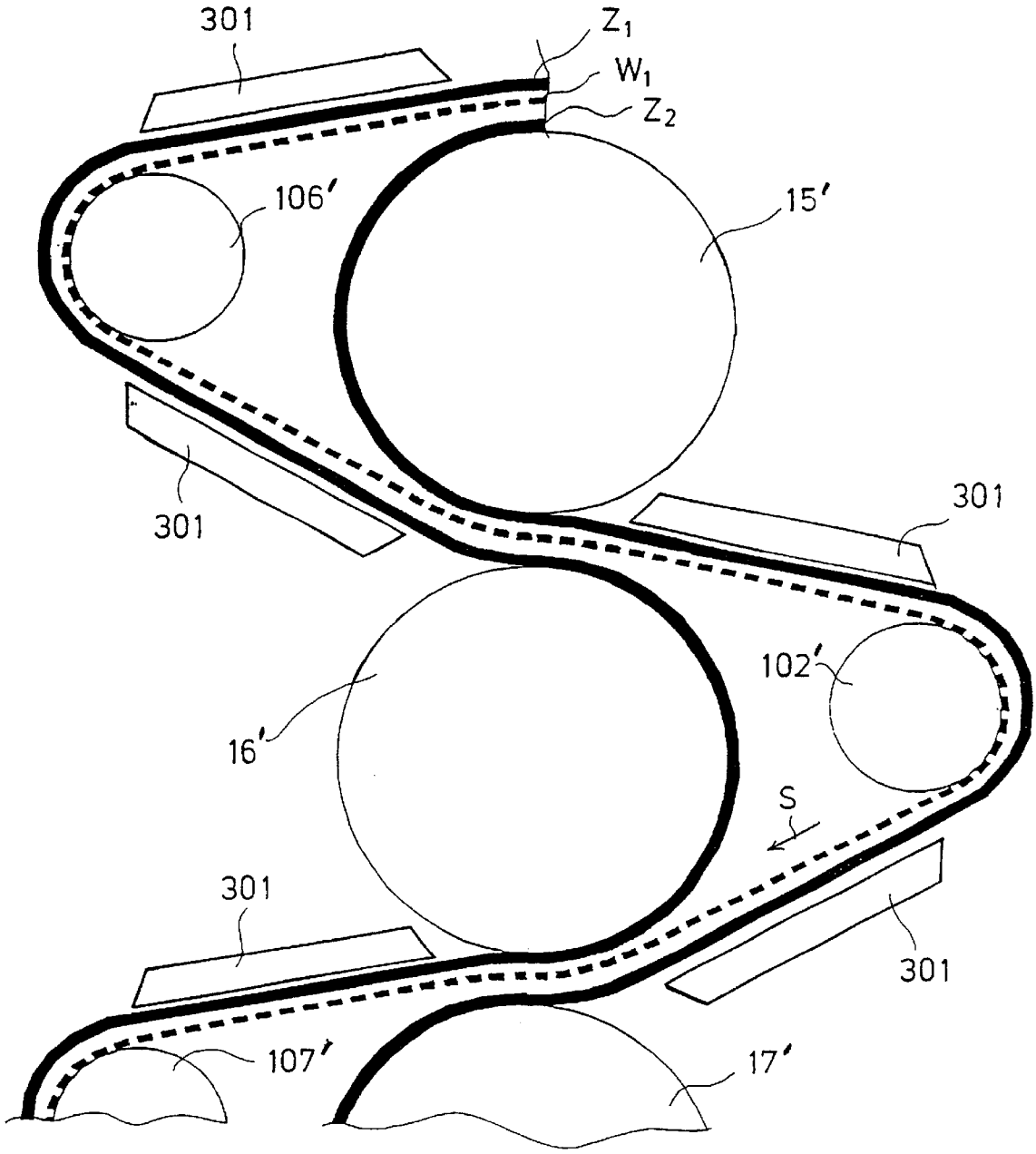
FIG. 5 is a schematic side view of a third arrangement of threading of a paper web in accordance with the present invention in a calender.

FIG. 5 shows a third arrangement of threading of a paper web in accordance with the invention in a calender. In the figure, just the belt pulleys 15',16',17' mounted on the axles of the intermediate rolls 15,16,17 in the calender and the belt pulleys 102',106',107' mounted on the axles of the corresponding take-out leading rolls 102,106,107 are shown. In this embodiment, two transfer belt loops $Z_1$,$Z_2$ are employed, which are penetrable by air and which extend through the whole calender. The first transfer belt loop Z, runs, at the take-out leading rolls 101 . . . 105 placed at the right side of the intermediate rolls 14,16,18,20,22, on the face of the belt pulley 16' mounted on the axle of the corresponding intermediate roll 14,16,18,20,22 and, at the take-out leading rolls 106 . . . 110 placed at the left side of the intermediate rolls 15,17,19,21,23, on the belt pulley 106',107' mounted on the axle of the take-out leading roll 106 . . . 110. The second transfer belt loop $Z_2$ runs, at the take-out leading rolls 101 . . . 105 placed at the right side of the intermediate rolls 14,16,18,20,22, on the belt pulley 102' mounted on the axle of the take-out leading roll 101 . . . 105 and, at the take-out leading rolls 106 . . . 110 placed at the left side of the intermediate rolls 15,17,19,21,23, on the belt pulley 15' mounted on the axle of the corresponding intermediate roll 15,17,19,21,23. On each of the free runs of the lead-in strip $W_1$ between the belt pulleys 15',16',17' of the rolls 12 . . . 23 in the set of rolls and the belt pulleys 106',102',107' of the take-out leading rolls 101 . . . 110, a suction box 301 has been fitted. The suction boxes 301 are placed at the opposite side of the transfer belt $Z_1$,$Z_2$, in relation to the lead-in strip $W_1$, and by means of the suction of the suction boxes, which is applied through the transfer belt $Z_1$,$Z_2$, the lead-in strip $W_1$ is kept in contact with the transfer belt $Z_1$,$Z_2$ on the free runs between the belt pulleys 15',16',17' of the rolls 12 . . . 23 in the set of rolls and the belt pulleys 106',102',107' of the take-out leading rolls 101 . . . 110.

In this arrangement, the lead-in strip $W_1$ of the paper web W runs, at the belt pulleys 106',107' of the take-out leading rolls 106 . . . 110 placed at the left side of the intermediate rolls 15,17,19,21, 23, between the outer face of the belt pulley and the first transfer belt $Z_1$, and, at the belt pulleys 102' of the take-out leading rolls 101 . . . 105 placed at the right side of the intermediate rolls 14,16,18,20,22, between the outer face of the belt pulley and the second transfer belt $Z_2$. The transfer of the lead-in strip $W_1$ from one transfer belt $Z_1,Z_2$ onto the other $Z_2,Z_1$ takes place by means of suction produced by the suction boxes at the nips $N_1$ . . . $N_{11}$ between the rolls 12 . . . 23 in the set of rolls. The transfer belts $Z_1,Z_2$ form closed loops, but also in this figure, the return circulations of the transfer belt loops $Z_1,Z_2$ from the outlet end of the calender to the inlet end of the calender are not shown. Also in this case, similarly to the situation illustrated in FIG. 1, the return circulation is arranged in a way in itself known by means of guide rolls.

Figure 6:
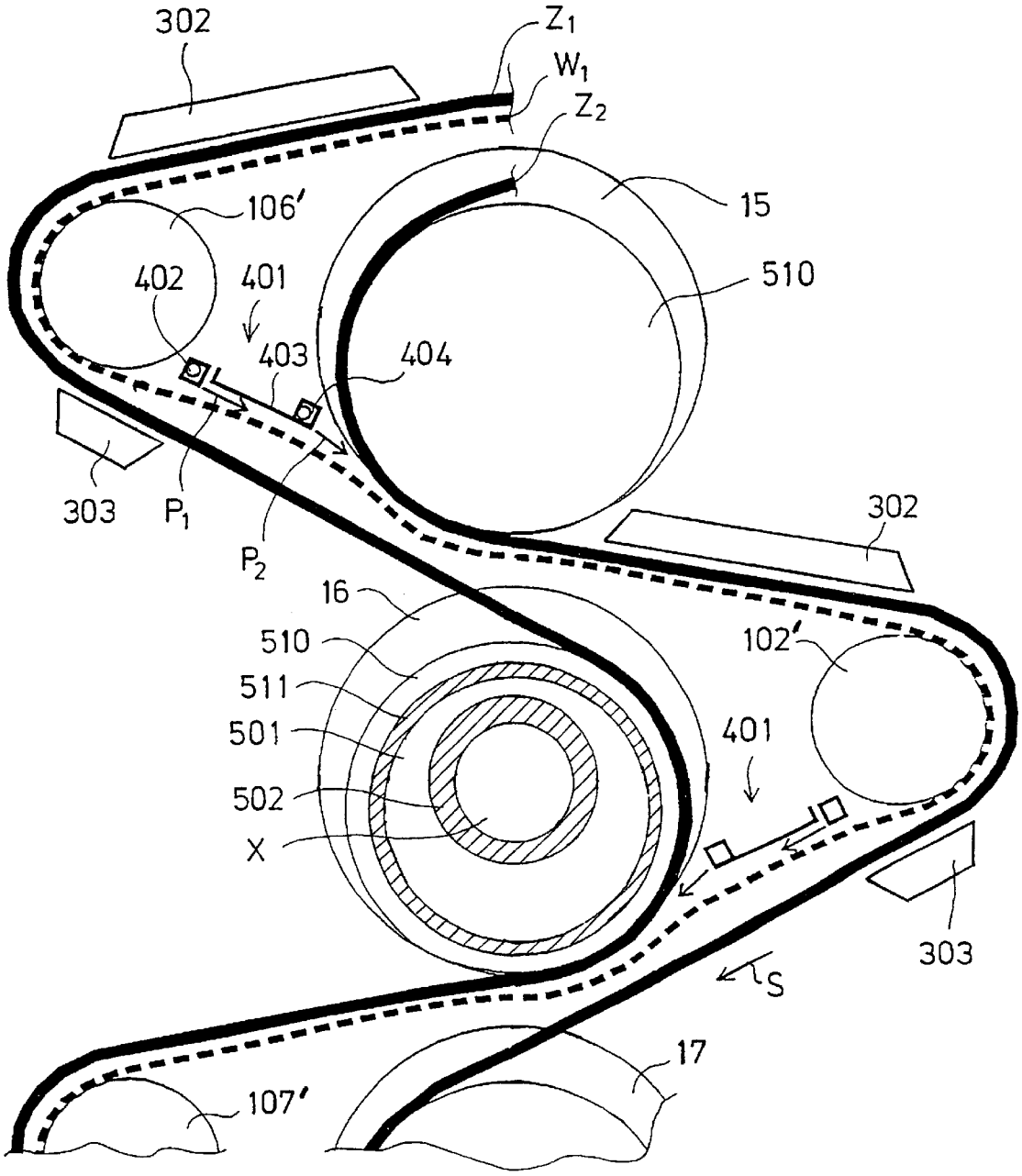
FIG. 6 is a schematic side view of a fourth arrangement of threading of a paper web in accordance with the present invention in a calender.

FIG. 6 shows a fourth embodiment of the invention, which is a modification of the third embodiment of the invention illustrated in FIG. 5. In this embodiment, two transfer belt loops $Z_1,Z_2$ are also used, whose running through the supercalender is, in principle, similar to the running described in the embodiment shown in FIG. 5, but in this embodiment the belts $Z_1,Z_2$ run on belt pulleys 510 fitted on eccentric wheels 501. Said belt pulleys have been mounted revolvingly by means of the bearing 511 on the outer circumference of the eccentric wheel 501, which eccentric wheel 501 has again been mounted revolvingly by means of the bearing 502 on the axles X of the rolls 12 . . . 23 in the set of rolls. Said eccentric wheel 501 has further been anchored on the frame of the supercalender so that it does not revolve. A horizontal plane formed at the lowest point of the outer mantle of the belt pulley 510 coincides with the horizontal plane formed at the lowest point of the outer mantle of the corresponding roll 12 . . . 23 in the set of rolls, and a horizontal plane formed at the highest point of the outer mantle of the belt pulley remains at a lower level in the vertical plane than the horizontal plane formed at the highest point of the corresponding roll 12 . . . 23 in the set of rolls.

In the embodiment shown in FIG. 6, on each of the free runs of the lead-in strip $W_1$ passing from the belt pulleys 510 placed in connection with the rolls 12 . . . 23 in the set of rolls onto the belt pulleys 106',102',107' of the take-out leading rolls 101 . . . 110, a first suction box 302 has been fitted, which is placed at the opposite side of the transfer belt $Z_1,Z_2$, in relation to the lead-in strip $W_1$. By means of the suction applied by said suction boxes 302 through the transfer belt $Z_1,Z_2$ to the lead-in strip $W_1$, the lead-in strip $W_1$ is kept in contact with the transfer belt $Z_1,Z_2$ on said free runs of the lead-in strip $W_1$. On each of the free runs of the lead-in strip $W_1$ passing from the belt pulleys 106',102',107' of the take-out leading rolls 101 . . . 110 onto the belt pulleys 510 of the intermediate rolls 14 . . . 23, further, a second suction box 303 has been fitted, which box starts substantially from the point at which the lead-in strip $W_1$ is separated from the outer face of the belt pulley 106', 102', 107' of the take-out leading roll 101 . . . 110 and extends a certain distance in the running direction S of the belt $Z_1,Z_2$ towards the belt pulley 510 of the intermediate roll 14 . . . 23. Also these second suction boxes 303 are placed at the opposite side of the transfer belt $Z_1,Z_2$, in relation to the lead-in strip $W_1$, and by means of their suction applied through the transfer belt $Z_1,Z_2$ to the lead-in strip $W_1$ the lead-in strip $W_1$ is kept in contact with the transfer belt $Z_1,Z_2$.

On each of the free runs of the lead-in strip $W_1$ passing from the belt pulley 106',102',107' of the take-out leading roll 101 . . . 110 onto the belt pulley 510 of the intermediate roll 14 . . . 23, further, a blow equipment 401 has been fitted, by whose means the lead-in strip $W_1$ is transferred from one transfer belt $Z_1,Z_2$ onto the other $Z_2,Z_1$. The blow equipment 401 is placed at the opposite side of the lead-in strip $W_1$, in relation to the transfer belt $Z_1,Z_2$, and the blow equipment extends substantially from the point at which the second suction box 303 ends to a point placed at a distance from the outer face of the mantle of the belt pulley 510 of the intermediate roll 14 . . . 23. The blow equipment 401 comprises a first blow device 402, a plate 403 parallel to the tangent between the belt pulley of the take-out leading roll 101 . . . 110 following after the first blow device 402 and the belt pulley 510 of the intermediate roll 14 . . . 23, and a second blow device 404 that follows after the plate 403. By means of the first blow device 402, a first blowing PI parallel to the face of the plate 403 placed at the side of the lead-in strip $W_1$ is produced and applied to said face, by means of which blowing $P_1$ a what is called Coanda effect is produced on said face. By means of the second blow device 404, a similar second blowing $P_2$ that follows the face placed at the side of the lead-in strip $W_1$ of the transfer belt $Z_1$, $Z_2$ running on the outer face of the mantle of the belt pulley 510 of the intermediate roll 14 . . . 23 is produced and applied to said belt face, by means of which second blowing a Coanda effect mentioned above is produced on said face.

By means of the above first blowing $P_1$ and by means of the Coanda effect produced by means of said blowing on the face of the plate 403, the lead-in strip $W_1$ is transferred from one transfer belt $Z_1,Z_2$ to run along the face of the plate 403, and by means of the second blowing $P_2$ the lead-in strip $W_1$ is transferred in a similar way, at the end of the plate 403, onto the other transfer belt $Z_2,Z_1$, which runs on the belt pulley 510 of the intermediate roll 14 . . . 23.

The situation in the embodiment shown in FIG. 6 can also be achieved by choosing the diameters of the rolls appropriately and by fitting the rolls in a suitable way. In such a case, a construction of eccentric wheels is not necessarily needed. In the embodiment shown in FIG. 6, one or several belt pulleys 510 can be provided with a drive gear/gears of their own, or one or several of them can be coupled with the rolls in the set of rolls in the calender so that they revolve along with the rolls.

As the transfer belt $Z,Z_1,Z_2,Z_{10},Z_{11},Z_{12}$, it is possible to use a belt penetrable by air and suitable for the purpose, such as, for example, a wire band, in which case the vacuum in the suction boxes 201 . . . 219,240,301 . . . 303 can act through the transfer belt $Z,Z_1,Z_2,Z_{10},Z_{11},Z_{12}$.

In the following, the patent claims will be given, and the details of the invention may show variation within the scope of the inventive idea defined in said claims and differ from what has been stated above by way of example only.

What is claimed is:

1. A multi-roll calender comprising an apparatus for threading a paper web (W), which calender comprises an upper roll (12), a lower roll (13), and at least one intermediate roll (14 . . . 23) fitted between the upper Toll (12) and the lower roll (13), which rolls have been arranged in the frame of the calender as a substantially vertical stack of rolls, in which connection the rolls (12 . . . 23) placed one above the other are in nip contact ($N_1$ . . . $N_{11}$) with one another, and which calender further comprises take-out leading rolls (101 . . . 110) fitted at the sides of the stack of rolls at each intermediate roll (14 . . . 23) alternatingly at the left side and at the right side, which take-out leading rolls have been attached to the support constructions of the intermediate rolls (14 . . . 23) concerned, which apparatus for threading comprises at least one loop of a transfer belt ($Z,Z_1,Z_2,Z_{10},Z_{11},Z_{12}$) which is penetrable by air and at least one suction member (201 . . . 205;210 . . . 219;30101;302, 303) which is placed on the free run of the at least one transfer belt at the opposite side of the at least one transfer belt in relation to a lead-in strip ($W_1$), which is kept in contact with the at least one transfer belt by means of the vacuum present in the at least one suction member, wherein the at least one transfer belt ($Z,Z_1,Z_2,Z_{10},Z_{11},Z_{12}$) is guided by belt pulleys (12' . . . 23'; 101' . . . 110') mounted on the axles of rolls (12 . . . 23) in the stack of rolls and on the axles of take-out leading rolls (101 . . . 110) or on narrower portions provided at the end of said rolls, the at least one transfer belt ($Z,Z_1,Z_2,Z_{10},Z_{11},Z_{12}$) running outside the edge of the web (W) through at least two passages formed between belt pulleys (12' . . . 23') of consecutive rolls (12 . . . 23) in the stack of rolls, and the lead-in strip ($W_1$) being passed on the support of the at least one transfer belt ($Z,Z_1,Z_2,Z_{10},Z_{11},Z_{12}$) through at least one passage formed between belt pulleys (12' . . . 23') of consecutive rolls (12 . . . 23) in the stack of rolls and that the at least one suction member (201 . . . 205; 210 . . . 219;301;302,303) is placed on a free run of the at least one transfer belt ($Z,Z_1,Z_2,Z_{10},Z_{11},Z_{12}$) between a belt pulley (12' . . . 23') of a roll (12 . . . 23) in the stack of rolls and a belt pulley (101' . . . 110') of a take-out leading roll (101 . . . 110).

2. The multi-roll calender as claimed in claim 1, wherein the at least one transfer belt is formed of a transfer belt loop (Z) penetrable by air and running through the whole calender guided by said belt pulleys (12' . . . 23';101' . . . 110') and that the at least one suction box is formed of a suction box (201 . . . 205;210 . . . 219) placed on each free run of the transfer belt (Z) between a belt pulley (12' . . . 23') of a roll in the stack of rolls (12 . . . 23) and a belt pulley (101' . . . 110') of the corresponding take-out leading roll (101 . . . 110) at the opposite side of the transfer belt (Z) in relation to the lead-in strip ($W_1$), in which connection the lead-in strip ($W_1$) is kept in contact with the transfer belt (Z) by means of the vacuum present in the suction boxes (201 . . . 205;210 . . . 219), and the lead-in strip is carried through the calender along with the transfer belt (Z).

3. The multi-roll calender as claimed in claim 2, wherein in the belt pulleys (101' . . . 105') of the take-out leading rolls (101 . . . 105) in the calender on which the lead-in strip ($W_1$) runs outside the transfer belt (Z) in relation to the outer face of the belt pulleys of the take-out leading rolls (101 . . . 105), grooves that run around the outer face of the belt pulley have been formed onto the outer face of the belt pulley, which grooves pass the vacuum present in a suction box (201 . . . 205) connected with said belt pulley of the take-out leading roll (101 . . . 105) over the belt pulley, in which connection the lead-in strip ($W_1$) remains in contact with the outer face of the transfer belt (Z) during the reversing.

4. The multi-roll calender as claimed in claim 2, wherein the belt pulleys (101' . . . 105') of the take-out leading rolls (101 . . . 105) in the calender on which the lead-in strip ($W_1$) runs outside the transfer belt (Z) in relation to the outer face of the belt pulleys of the take-out leading rolls (101 . . . 105), the belt pulley is a belt pulley provided with a perforated mantle and with a suction zone, by whose means the lead-in strip ($W_1$) is kept in contact with the outer face of the transfer belt (Z) during the reversing.

5. The multi-roll calender as claimed in claim 2, wherein the belt pulleys (101' . . . 105') of the take-out leading rolls (101 . . . 105) in the calender on which the lead-in strip ($W_1$) runs outside tile transfer belt (Z) in relation to the outer face of the belt pulleys of the take-out leading rolls (101 . . . 105), the mantle of the belt pulley is provided with perforations, and a vacuum is present in the interior of the belt pulley, by means of which vacuum the lead-in strip ($W_1$) is kept in contact with the outer face of the transfer belt (Z) during the reversing.

6. The multi-roll calender as claimed in claim 1, wherein the at least one transfer belt is formed of separate consecutive transfer belt loops ($Z_{10},Z_{11},Z_{12}$) penetrable by air so that each transfer belt loop runs around a pair of belt pulleys (14',101'; . . . ; 23',110') formed of a belt pulley (14' . . . 23') of an intermediate roll (14 . . . 23) and a belt pulley (101' . . . 110') of a corresponding take-out leading roll (101 . . . 110), and that the suction box(es) is formed of a suction box (202, 240, 203) placed in an area defined by the pair of belt pulleys and by the corresponding transfer belt loop ($Z_{10,Z11},Z_{12}$).

7. The multi-roll calender as claimed in claim 6, wherein the arrangement further comprises a blow member (501,511) placed inside each transfer belt loop ($Z_{10},Z_{11},Z_{12}$) and inside each belt pulley (14',15',16') substantially at the passage between two belt pulleys through which passage the transfer belt ($Z_{10},Z_{11},Z_{12}$) concerned transfers the lead-in strip ($W_1$), the lead-in strip ($W_1$) being separated, by means of a blowing ($P_{10},P_{11}$) applied through the perforated mantle of said belt pulley (14',15',16') and through the transfer belt ($Z_{10},Z_{11},Z_{12}$), from the former transfer belt ($Z_{10},Z_{11}$, $Z_{12}$), which transferred the strip through the passage, and being transferred onto the next transfer belt ($Z_{10}Z_{11},Z_{12}$).

8. The multi-roll calender as claimed in claim 6, wherein the arrangement further comprises a blow device (601,611) integrated in a suction box (202,240,203), by means of which blow device a blowing is applied to the closing nip between the transfer belt ($Z_{10},Z_{11}$) and the belt pulley (14', 15') of the intermediate roll in order to separate the lead-in strip ($W_1$) from the preceding transfer belt ($Z_{10},Z_{11}$) and to transfer the strip onto the next transfer belt ($Z_{11},Z_{12}$).

9. The multi-roll calender as claimed in claim 1, wherein the arrangement of threading comprises two transfer belt loops ($Z_1,Z_2$) penetrable by air, the running of said belt loops through the calender being arranged so that C the first transfer belt loop ($Z_1$) runs at the take-out leading rolls (101 . . . 105) placed at the right side of the intermediate rolls (14 . . . 23) on the outer face of the belt pulley (14',16',18', 20',22') of the corresponding intermediate roll (14,16,18,20, 22) and at the take-out leading rolls (106 . . . 110) placed at the left side of the intermediate rolls (14 . . . 23) on the outer face of the belt pulley (106' . . . 110') of the take-out leading roll (106 . . . 110), the second transfer belt loop (Z) runs at the take-out leading rolls (101 . . . 105) placed at the right side of the intermediate rolls (14 . . . 23) on the outer face of the belt pulley (101' . . . 105') of the take-out leading roll (101 . . . 105) and at the take-out leading rolls (106 . . . 110) placed at the left side of the intermediate rolls (14 . . . 23) on the outer face of the belt pulley (15',17',19',21',23') of the corresponding intermediate roll (15,17,19,21,23), and the transfer belt loops ($Z_1,Z_2$) run on opposite belt pulleys at the nip points between the rolls (12 . . . 23) in the set of rolls, in which connection the lead-in strip ($W_1$) runs at the take-out leading rolls (106 . . . 110) placed at the left side of the intermediate rolls (14 . . . 23) between the first transfer belt ($Z_1$) and the outer face of the belt pulley (106' . . . 110 ) of the take-out leading roll (106 . . . 10), and at the take-out leading rolls (10 . . . 105) placed at the right side of the intermediate rolls (14 . . . 23) between the second transfer belt ($Z_2$) and the outer face of the belt pulley (101' . . . 105') of the take-out leading roll (101 . . . 105).

10. The multi-roll calender as claimed in claim 9, wherein a suction box (301) is fitted on each of the free runs of the lead-in strip ($W_1$) between the belt pulleys of the rolls (12 . . . 23) in the set of rolls and the belt pulleys of the take-out leading rolls (101 . . . 110) at the opposite side of the transfer belts ($Z_1,Z_2$) in relation to the lead-in strip ($W_1$), the lead-in strip ($W_1$) being kept in contact with the transfer belt ($Z_1$,$Z_2$) on said free runs by means of the vacuum of said suction box acting through the transfer belt ($Z_1$,$Z_2$), in which connection the lead-in strip ($W_1$) is transferred, at the nip ($N_1$ . . . $N_{11}$) at each of the rolls (12,23) in the set of rolls, from one transfer belt ($Z_1$,$Z_2$) onto the other ($Z_2$,$Z_1$).

11. The multi-roll calender as claimed in claim 10, wherein a suction box (302) is fitted on each of the free runs of the lead-in strip ($W_1$) passing from the belt pulleys of the rolls (12 . . . 23) in the set of rolls onto the belt pulleys of the take-out leading rolls (101 . . . 110) at the sides of the transfer belts ($Z_1$,$Z_2$) opposite to the lead-in strip ($W_1$), the lead-in strip ($W_1$) being kept in contact with the transfer belt ($Z_1$,$Z_2$) on said free runs of the lead-in strip ($W_1$) by means of the vacuum of said suction box acting through the transfer belt ($Z_1$,$Z_2$).

12. The multi-roll calender as claimed in claim 11, wherein a suction box (303) is fitted on each of the free runs of the lead-in strip ($W_1$) passing from the belt pulleys of the take-out leading rolls (101 . . . 110) onto the belt pulleys of the rolls (12 . . . 23) in the set of rolls, substantially at the point at which the transfer belt ($Z_1$,$Z_2$) is separated from the belt pulley (101' . . . 110') of the take-out leading roll (101 . . . 110), at the opposite side of the transfer belt ($Z_1$,$Z_2$) in relation to the lead-in strip ($W_1$), the lead-in strip ($W_1$) being separated, by means of the vacuum of said suction box acting through the transfer belt ($Z_1$,$Z_2$), from the face of the belt pulley (101' . . . 110') of the take-out leading roll (101 . . . 110) and being transferred onto the face of the transfer belt ($Z_1$,$Z_2$).

13. The multi-roll calender as claimed in claim 12, wherein an air blowing equipment (401) is fitted on each of the free runs of the lead-in strip ($W_1$) passing from the belt pulleys of the take-out leading rolls (101 . . . 110) onto the belt pulleys of the rolls (12 . . . 23) in the set of rolls, at the opposite side of the lead-in strip ($W_1$) in relation to the transfer belt ($Z_1$,$Z_2$), by means of which air blowing equipment (401) the lead-in strip ($W_1$) is transferred from the face of one transfer belt ($Z_1$,$Z_2$) onto the face of the other transfer belt ($Z_2$,$Z_1$).

14. The multi-roll calender as claimed in claim 13, wherein at one end of each of the rolls (12 . . . 23) in the set of rolls in the calender, a belt pulley (510) has been mounted on an eccentric wheel (501) revolvingly by means of a bearing (511), so that a horizontal plane formed at the lowest point of the outer face of the mantle of the belt pulley (510) and the horizontal plane formed at the lowest point of the outer face of the mantle of the corresponding nip roll (12 . . . 23) coincide with each other, and the horizontal plane formed at the highest point of the outer face of the mantle of the belt pulley (510) remains, in the vertical plane, at a lower level than the horizontal plane formed at the highest point of the mantle of the roll (12 . . . 23) in the set of rolls, in which connection the reversing of the running direction of the transfer belt ($Z_1$,$Z_2$) takes place on the outer face of the mantle of the belt pulley (510), and the transfer belts ($Z_1$,$Z_2$) are placed at a distance from one another at the nips ($N_1$, $N_{11}$) of the rolls (12 . . . 23) in the set of rolls at the side of the nips.

15. The multi-roll calender as claimed in claim 14, where each eccentric wheel (501) has been mounted revolvingly by means of a bearing (502) on the axle (X) of the corresponding nip roll (12 . . . 23).

* * * * *